US005240392A

United States Patent [19]

Fukanuma et al.

[11] Patent Number: 5,240,392

[45] Date of Patent: Aug. 31, 1993

[54] SCROLL TYPE COMPRESSOR WITH OIL-SEPARATING PLATE IN DISCHARGE CHAMBER

[75] Inventors: Tetsuhiko Fukanuma; Yuji Izumi; Tatsushi Mori; Tetsuo Yoshida, all of Kariya, Japan

[73] Assignee: Kabushiki Kaisha Toyoda Jidoshokki Seisakusho, Kariya, Japan

[21] Appl. No.: 843,628

[22] Filed: Feb. 28, 1992

[30] Foreign Application Priority Data

Mar. 6, 1991 [JP] Japan ..... 3-40233

[51] Int. Cl.[5] ..... F04C 18/04; F04C 29/02

[52] U.S. Cl. ..... 418/55.6; 418/100; 418/DIG. 1; 418/97

[58] Field of Search ..... 418/55.6, 97-100, 418/DIG. 1

[56] References Cited

U.S. PATENT DOCUMENTS

| | | | |
|---|---|---|---|
| 3,820,924 | 6/1974 | Cassidy et al. | 418/89 |
| 4,279,578 | 7/1981 | Kim et al. | 418/97 |
| 4,936,756 | 6/1990 | Shimizu et al. | 418/55.6 |
| 5,076,771 | 12/1991 | Ban et al. | 418/55.6 |

FOREIGN PATENT DOCUMENTS

| | | | |
|---|---|---|---|
| 0052234 | 5/1982 | European Pat. Off. . | |
| 58-170876 | 10/1983 | Japan . | |
| 59-185892 | 10/1984 | Japan | 418/99 |
| 1-32088 | 2/1989 | Japan | 418/55.6 |
| 8505403 | 12/1985 | PCT Int'l Appl. . | |

*Primary Examiner*—John J. Vrablik

*Attorney, Agent, or Firm*—Brooks Haidt Haffner & Delahunty

[57] ABSTRACT

In a scroll type compressor, a movable scroll is engaged with an immovable scroll so that spaces are formed for taking in a fluid including a lubricating oil mist to be compressed. The movable scroll is revolved around a central axis of the immovable scroll so that, as the spaces are displaced toward a center of the immovable scroll, a volume thereof is reduced to compress the fluid therein. The immovable scroll has a passage through which each of the spaces is communicated with a discharge chamber upon reaching the center, whereby the compressed fluid is successively discharged through the passage into the chamber. An oil-separating plate is disposed in the chamber at a given level lower than the passage, and a reed valve is provided at the passage. A retainer for the reed valve is shaped such that the compressed fluid discharged from the passage through the reed valve is directed to and impinged on an upper surface of the plate, to thereby separate a lubricating oil from fluid, whereby the separated oil is reserved in a lower portion of the chamber defined by the plate, and thus a level of the reserved oil is maintained at the upper surface thereof.

3 Claims, 4 Drawing Sheets

SCROLL TYPE COMPRESSOR WITH OIL-SEPARATING PLATE IN DISCHARGE CHAMBER

BACKGROUND OF THE INVENTION

1) Field of the Invention

The present invention relates to a scroll type compressor which can be used, for example, in an air-conditioning system of a vehicle such as an automobile, and more particularly, to a scroll type compressor provided with an improved lubricating arrangement for movable parts thereof.

2) Description of the Related Art

For example, Japanese Unexamined Patent Publication No. 57-62988 discloses a scroll type compressor for an air-conditioning system of an automobile, which comprises immovable and movable scroll members housed in a housing and having spiral guide walls engaged with each other in such a manner that spaces are formed as a compression chamber therebetween. The movable scroll member is revolved around a center axis of the immovable scroll member in such a manner that an engagement is maintained between the spiral guide walls of the immovable and movable scroll member, and that the spaces or compression chambers therebetween are displaced toward centers of the spiral guide walls.

During the revolution of the movable scroll member around the center axis of the immovable scroll member, a compression chamber appears successively at the outsidemost portions of the spiral guide walls thereof, and opens to take in a refrigerant, including a lubricating oil mist, fed from an evaporator of the air-conditioning system, and then the compression chamber concerned is fully closed by the spiral guide walls, due to the revolution of the movable scroll member. Thereafter, as the compression chamber concerned is displaced toward the centers of the spiral guide walls, a volume thereof becomes gradually smaller, whereby the refrigerant confined therein is compressed, and when the compression chamber concerned reaches the centers of the spiral guide walls, the compressed refrigerant is discharged through a reed valve into a discharge chamber formed in the housing of the compressor. After the discharge of the compressed refrigerant into the discharge chamber is completed, the compression chamber concerned disappears at the centers of the spiral guide walls, and thus a compression of the refrigerant is successively carried out.

To cause the revolution of the movable scroll member around the central axis of the immovable scroll member, the compressor comprises a drive shaft projected from the housing and operatively connected to and rotated by a prime mover of the vehicle, and an eccentric mechanism provided between the drive shaft and the movable scroll member for converting the rotation of the drive shaft into the revolution of the movable scroll member. The drive shaft is provided with a seal assembly to prevent a leakage of the refrigerant from the housing, and is rotatably supported by a radial bearing. The eccentric mechanism includes an eccentric pin element projected from an enlarged portion of the drive shaft, and a bush element rotatably engaged with the eccentric pin element and rotatably received in a sleeve portion projected from the movable scroll member through the intermediary of a radial bearing. The drive shaft, the bush element and the sleeve portion are axially aligned with each other, and thus the movable scroll member can be revolved around the central axis of the immovable scroll member by the rotation of the drive shaft.

Also, to constrain the movement of the movable scroll member, to thereby ensure the revolution thereof around the central axis of the immovable scroll member, the compressor comprises a first annular plate fixedly disposed at a rear side of the movable scroll member and having a plurality of circular recesses formed therein, and a second annular plate attached to a rear side wall surface of the movable scroll member and facing the first annular plate, and having the same number of circular recesses formed therein. The circular recesses of the first and second annular plates are radially disposed so that each of the circular recesses of the first annular plate partially overlaps the corresponding circular recess of the second annular plate, and two shoe elements are slidably received in each pair of the partially overlapped circular recesses of the first and second annular plates in such a manner that a ball element is slidably disposed between and held by the two shoe elements. With this arrangement, the movement of the movable scroll member is constrained, and thus the revolution thereof around the central axis of the immovable scroll member is ensured.

The various movable parts of the compressor as mentioned above are exposed to the refrigerant fed from an evaporator of the air-conditioning system, and thus are lubricated with lubricating oil separated from refrigerant. When an excessive amount of the oil mist is included in the refrigerant, although the movable parts are sufficiently lubricated, the larger the amount of oil mist, the lower the cooling efficiency of the air-conditioning system, and accordingly, in the conventional compressor, the compressed refrigerant discharged from the compression chamber into the discharge chamber through the reed valve is directed to and impinged on an inner wall surface of the discharge chamber, so that a part of the oil mist is separated from the refrigerant, and the separated oil is stored in the discharge chamber. Nevertheless, an amount of the separated oil obtained depends upon the running conditions of the compressor, such as a rotational speed of the drive shaft and a rate of flow of the compressed and discharged refrigerant, etc., and thus an amount of the oil mist included in the refrigerant cannot be maintained at a constant value during the running of the compressor. Accordingly, when an amount of the oil mist is too small, the movable parts are not sufficiently lubricated and may seize up. Conversely, when the amount of the oil mist is too large, the cooling efficiency of the air-conditioning system is lowered, as mentioned above.

SUMMARY OF THE INVENTION

Therefore, an object of the present invention is to provide a scroll type compressor having an improved lubricating arrangement wherein an amount of the oil mist included in the refrigerant can be maintained at a constant value even when the running conditions of the compressor vary.

In a scroll type compressor according to the present invention, immovable and movable scroll members are housed in a housing and have spiral guide walls engaged with each other such that spaces or compression chambers for taking in a fluid including a lubricating oil mist to be compressed are formed therebetween. The movable scroll member is revolved around a center axis of the immovable scroll member in such a manner that, as the compression chambers are displaced toward a center of the immovable scroll member, a volume thereof is reduced to thereby cause a compression of the fluid in the compression chambers. The immovable scroll member has a passage through which each of the compression chambers is communicated with a discharge chamber upon reaching the center of the immovable scroll member, whereby the compressed fluid is successively discharged through the passage into the discharge chamber. An oil-separating plate member is provided in the discharge chamber at a given level lower than the passage, and a reed valve element is provided at the passage. A retainer element for retaining the reed valve element is shaped such that the compressed fluid discharged from the passage through the reed valve element is directed to and impinged on an upper surface of the oil-separating plate member, to thereby separate a lubricating oil from the fluid, whereby the separated oil is reserved in a lower portion of the discharge chamber defined by the oil separating plate member and thus a level of the reserved oil is maintained at the upper surface of the oil-separating plate member.

BRIEF DESCRIPTION OF THE DRAWINGS

The above-mentioned object and other objects of the present invention will be better understood from the following description, with reference to the accompanying drawings, in which.

DESCRIPTION OF THE PREFERRED EMBODIMENTS

Figure 1:
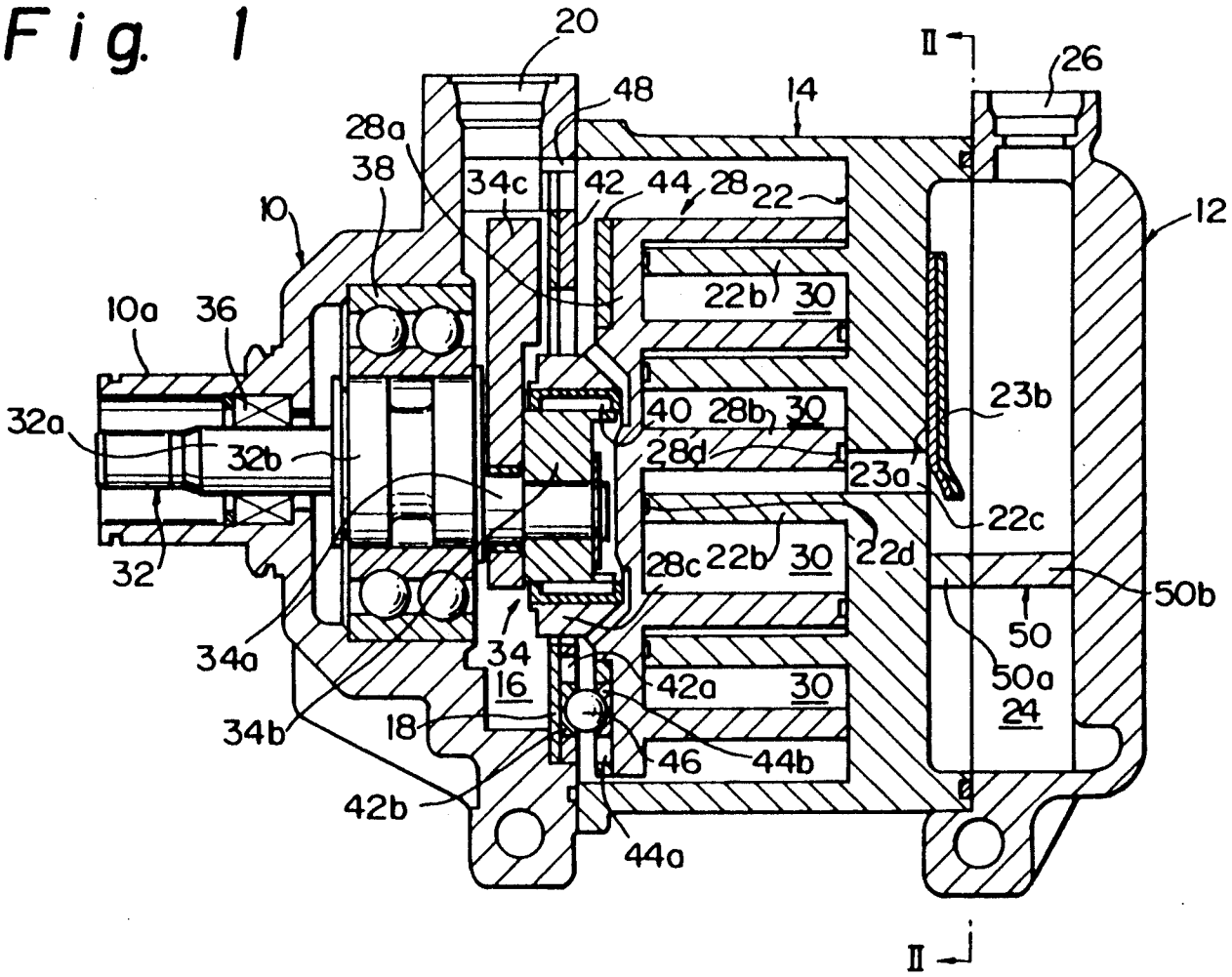
FIG. 1 is a longitudinal sectional view of a scroll type compressor constructed according to the present invention.
Figure 2:
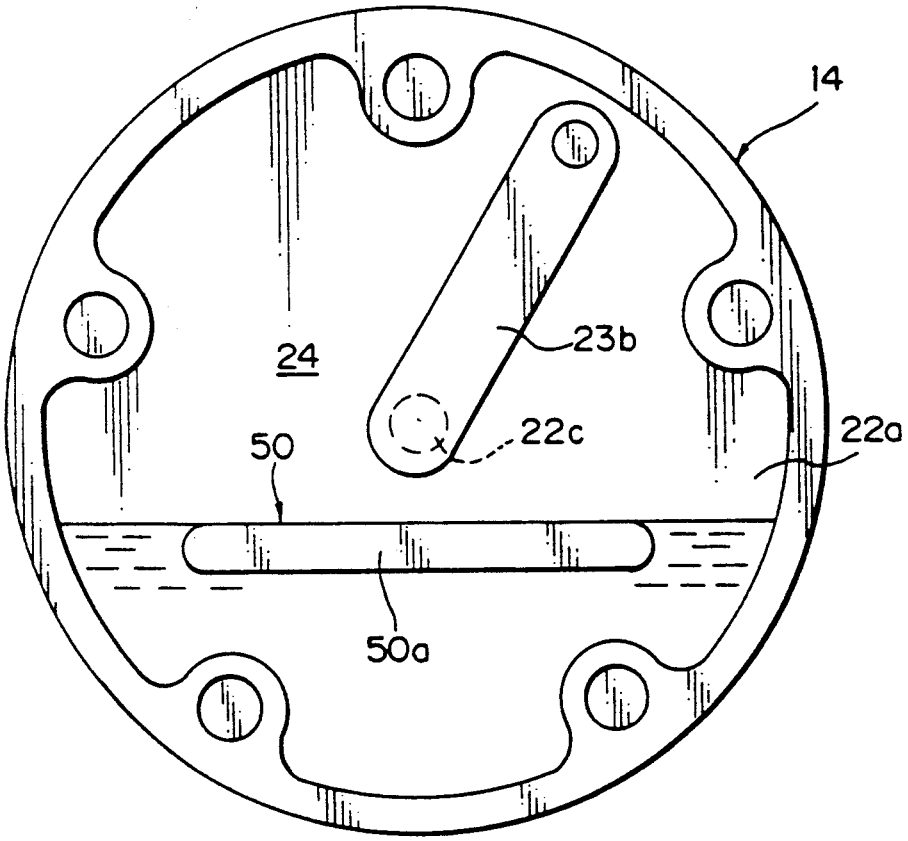
FIG. 2 is a cross-sectional view taken along the line II—II of FIG. 1.

FIGS. 1 and 2 show a first embodiment of a scroll type compressor according to the present invention. This compressor comprises front and rear housings 10 and 12, and an intermediate housing 14 disposed therebetween, and the front and rear housings 10 and 12 are joined to the front and rear ends of the intermediate housing 14 by screws (not shown) extending through the housings 10, 14 and 12. The front housing 10 defines a suction chamber 16 together with an annular disk plate 18 fixedly disposed at a boundary between the front and intermediate housings 10 and 14, and the suction chamber 16 is in communication with, for example, an evaporator of an air-conditioning system (not shown), through an inlet port 20 formed in a side wall of the front housing 10, whereby a refrigerant including a lubricating oil mist is fed to the suction chamber from the evaporator.

The compressor also comprises an immovable scroll member 22 housed in the intermediate housing 14 and including a base portion **22*a* integrally formed therewith, and a spiral guide wall 22*b* projected from a front wall surface of the base portion 22*a*. As apparent from FIG. 1, the base portion 22*a* of the scroll member 22 defines a discharge chamber 24 together with the rear housing 12, and the discharge chamber 24 is communicated with a condenser of the air-conditioning system through an outlet port 26 formed in a side wall of the rear housing 12. The base portion 22*a* of the immovable scroll member 22 has a central through passage 22*c* formed therein, and thus an inner chamber defined by the intermediate housing 14 is in communication with the discharge chamber 24. The through passage 22*c* is usually closed by a reed valve 23*a* attached to the rear side wall surface of the base portion 22*a*, and when the reed valve 23*a* is open as shown in FIG. 1, it is held open by a retainer 23*b***.

The compressor further comprises a movable scroll member 28 movably disposed in the intermediate housing 14 and including a base portion **28*a* integrally formed therewith, and a spiral guide wall 28*b* projected from a rear wall surface of the base portion 28*a*. The spiral guide wall 28*b* of the movable scroll member 28 is engaged with the spiral guide wall 22*b* of the immovable scroll member 22 so that spaces or compression chambers 30 are formed therebetween. Each of the spiral guide walls 22*b* and 28*b*** may have a profile defined by an involute line.

The movable scroll 28 is revolved around an central axis of the immovable scroll member 22 in such a manner that an engagement is maintained between the spiral guide walls **22*b* and 28*b*, whereby the compression chambers 30 are successively displaced toward the center of the immovable scroll member 22. To this end, the compressor comprises a drive shaft 32 operatively connected to and rotated by a prime mover of the vehicle (not shown), and an eccentric mechanism 34 provided between the drive shaft 32 and the movable scroll member 28 for converting the rotation of the drive shaft 32 into the revolution of the movable scroll member 28**.

In particular, the drive shaft 32 includes a shaft portion **32*a* and an enlarged portion 32*b* integrated with an inner end thereof, and is disposed within the front housing 10 so that a longitudinal axis thereof is aligned with the central axis of the immovable scroll member 22. The shaft portion 32*a* of the drive shaft 32 is received in an outer sleeve portion 10*a* projected from the front housing 10 and is rotatably supported by a seal-assembly 36 disposed in the outer sleeve portion 10*a*, and the enlarged portion 32*b* thereof is received in and rotatably supported by a radial bearing 38 fixedly housed in the front housing 10. Note, the shaft portion 32*a* is operatively connected to, for example, a prime mover of the vehicle, through a suitable clutch such as an electromagnetic clutch. The eccentric mechanism 34 includes an eccentric pin element 34*a* integrally projected from an inner end face of the enlarged portion 32*b* of the drive shaft 32, and a bush element 34*b* rotatably engaged with the eccentric pin element 34*a* and rotatably received in a sleeve portion 28*c* projected from the movable scroll member 28 into a central opening of the annular disk plate 18 and provided with a radial bearing 40 for rotatably receiving the bush element 34*b*. With this arrangement, the movable scroll member 28 can be revolved around the central axis of the immovable scroll member 22 by the rotation of the drive shaft 32. Note, the eccentric pin element 34*b* is provided with a counterweight 34*c*, to ensure that the eccentric mechanism 46** is stably driven.

To constrain the movement of the movable scroll member 28 so as to ensure the revolution thereof around the central axis of the immovable scroll member 22, the compressor comprises a first annular plate 42 fixedly attached to the annular disk plate 18 at a rear side thereof and having a plurality of circular recesses 42a formed therein, and a second annular plate 44 attached to a rear side wall surface of the movable scroll member 28 so as to face the first annular plate 42 and having the same number of circular recesses 44a formed therein. The circular recesses 42a and 44a of the first and second annular plates 42 and 44 are radially disposed at regular intervals so that each of the circular recesses 42a of the first annular plate 42 partially overlaps the corresponding circular recess 44a of the second annular plate 44, and two shoe elements 42b and 44b are slidably received in each pair of the partially overlapped circular recesses 42a and 44a of the first and second annular plates, respectively, so that a ball element 46 is slidably disposed between and held by the two shoe elements 42b and 44b. With this arrangement, the movement of the movable scroll member is constrained so that the revolution thereof around the central axis of the immovable scroll member can be ensured. Namely, a rotation of the movable scroll member 28 around its own central axis is prevented during the revolution thereof around the central axis of the immovable scroll member.

Although the inner chamber of the intermediate housing 14 is in communication with the suction chamber 16 defined by the front housing 10 through the central openings of the annular disk plate 18 and the first annular plate 42, a further communication therebetween is provided with a through passage 48 formed and disposed at a location beside a rotational zone of the counterweight 34c, and thus a sufficient amount of the refrigerant is fed from the suction chamber 16 to the inner chamber of the intermediate housing 14.

In operation, each of the compression chambers 30 initially appears at the outermost portions of the spiral guide walls 28b and 22b of the movable and immovable scroll members 28 and 22 and opens to the inner chamber of the intermediate housing 14, so that the refrigerant is introduced thereinto, and then the compression chamber 30 concerned is completely closed by the spiral guide walls 28b and 22b due to the revolution of the movable scroll member 28. As the compression chamber 30 concerned is displaced toward the center of the immovable scroll member 22, the volume thereof becomes gradually smaller so that the refrigerant confined therein is compressed, and when the compression chamber 30 concerned reaches the center of the immovable scroll member 22, it is brought into communication with the central through passage 22c of the immovable scroll member 22, so that the reed valve 23a is opened by the compressed refrigerant and the compressed refrigerant is discharged into the discharge chamber 24. Thereafter, the compression chamber 30 concerned disappears at the center of the immovable scroll member 22, and a new compression chamber successively appears at the outermost portions thereof during the revolution of the movable scroll member 28, whereby compression of the refrigerant can be consecutively carried out. The compressed refrigerant is fed to the condenser of the air-conditioning system through the outlet port 26.

During the running of the compressor, all of the movable parts are exposed to the refrigerant, and thus lubricated with a lubricating oil separated from the refrigerant. In an assembly of the immovable and movable scroll members 22 and 28, the lubricating oil separated from the refrigerant also serves as a sealing material. Particularly, the compression chambers 30 defined by the spiral guide walls 22b and 28b are sealed by the lubricating oil existing at contacting locations between the spiral guide walls 22b and 28b. Further, the tops of the spiral guide walls 22b and 28b, in contact with inner wall surfaces of the base portions 28 and 22, are provided with spiral grooves 22d and 28d formed at the tops thereof, respectively, and are filled with the lubricating oil separated from the refrigerant, whereby the filled oil serves as a top seal.

The compressor according to the present invention is characterized in that a horizontal plate member 50 is provided in the discharge chamber 24 at a given level, and that the retainer 23b is shaped such that, when the reed valve 23a is opened and held thereby, the compressed refrigerant discharged from the through passage 22c is directed to the horizontal plate member 50. The horizontal plate member 50 includes a first ledge portion 50a projected from the base portion 22a of the immovable scroll member 22 and a second ledge portion 50b projected from the rear housing 12. Namely, the first and second ledge portions 50a and 50b are not provided with the horizontal plate member 50 until the rear housing 12 is mounted on the intermediate housing 14. The first ledge portion 50a is not extended to a peripheral inner wall surface of the intermediate housing 14, as shown in FIG. 2, and the second ledge portion 50b is laterally coextended with respect to the first ledge portion 50a. Namely, an upper portion of the discharge chamber 24 defined by the plate member 50 is in communication with a lower portion thereof at the lateral end sides of the plate member 50.

The horizontal plate member 50 serves as an oil-separating plate. In particular, when the compressed refrigerant discharged from the through passage 22c is directed to and impinged on the plate member 50, the lubricating oil is separated therefrom. The separated oil is reserved in the lower portion of the discharge chamber 24 defined by the plate member 50. The separation of the oil from the refrigerant is continued until the level of the reserved oil reaches an upper surface of the horizontal plate member 50. When the level of the reserved oil becomes higher than the upper surface of the plate member 50, no further separation of the oil from the refrigerant occurs, but instead an oil surface of the reserved oil is made turbulent by the compressed refrigerant discharged from the through passage 22c, so that a part of the reserved oil is entrained with the refrigerant as an oil mist. The entrainment of the oil with the refrigerant is continued until the level of the reserved oil is lowered to the upper surface of the plate member 50, and thus the level of the reserved oil can be maintained at the upper surface of the plate member 50 during the running of the compressor, as shown in FIG. 2. Namely, a total amount of the oil mist included in the refrigerant can be substantially maintained at a constant value, and thus a fluctuation of an cooling efficiency of the air-conditioning system can be substantially prevented. Of course, the level of the upper surface of the horizontal plate member 50 is selected so that the refrigerant includes an amount of the oil mist sufficient to lubricate the movable parts of the compressor.

Figure 3:
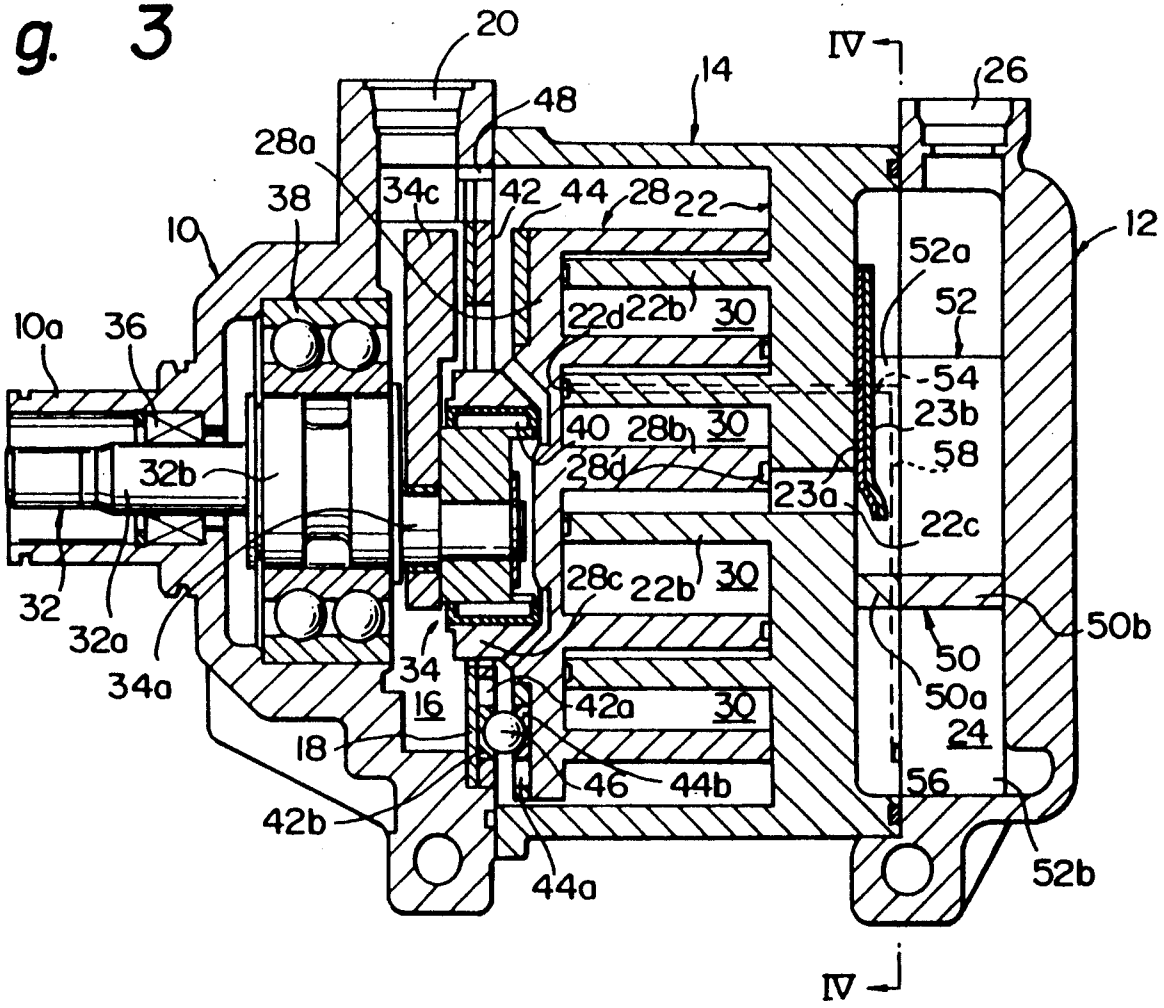
FIG. 3 is a longitudinal sectional view of a modification of the scroll type compressor shown in FIGS. 1 and 2.
Figure 4:
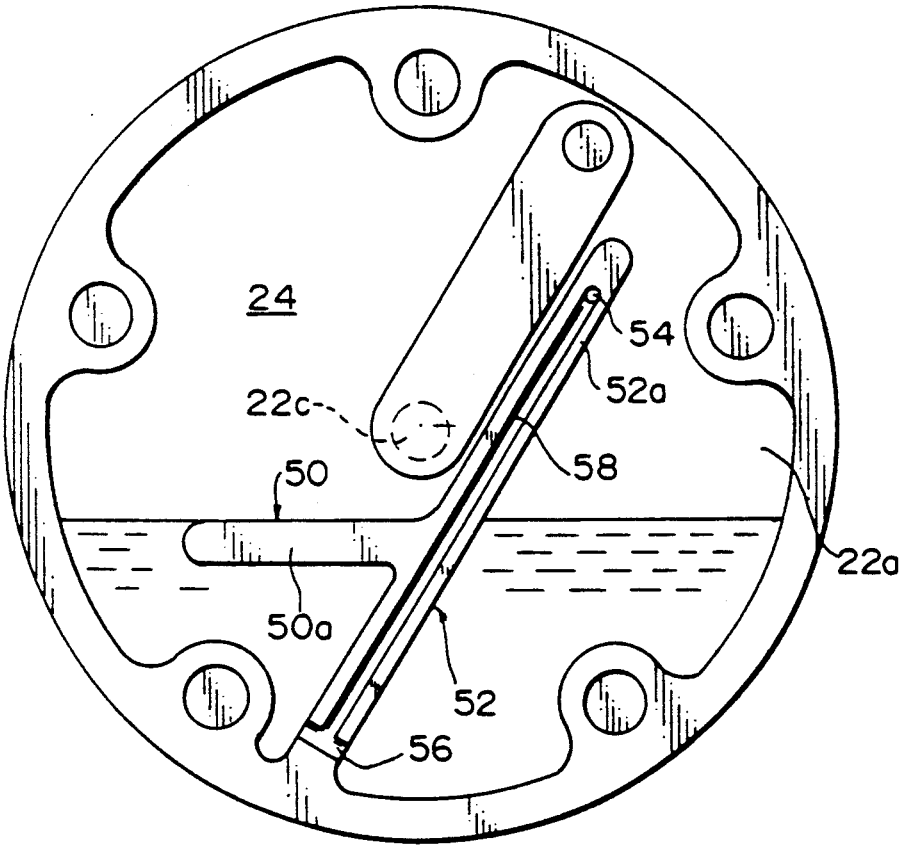
FIG. 4 is a cross-sectional view taken along the line IV—IV of FIG. 3.

FIGS. 3 and 4 show a modification of the embodiment of FIGS. 1 and 2. Note, in FIGS. 3 and 4, features similar to those of FIGS. 1 and 2 are indicated by the same reference numerals. In this modification, the horizontal plate member 50 has an additional sloped plate member 52 including a first portion 52a integrally formed with the first ledge portion 50a and projected from the base portion 22a of the immovable scroll member 22, and a second portion 52*b* integrally formed with the second ledge portion 50*b* and projected from the rear housing 12. The first portion 52*a* has an oil passage 54 formed at an upper end thereof and extended to the spiral groove 22*d* through the base portion 22*a* and spiral guide wall 22*b* of the immovable scroll member 22. The first portion 52*a* also has a lateral through slot 56 formed at a lower end thereof, and an elongated groove 58 formed in an end face thereof and communicating the oil passage 54 and the lateral through slot 56. When the rear housing 12 is mounted on the intermediate housing 14, the end face of the first portion 52*a* is mated with an end face of the second portion 52*b*, so that the lateral through slot and the elongated groove 58 are closed, to thereby provide an oil passage and an oil intake port, respectively. As a pressure of the discharge chamber is maintained at a high level during the running of the compressor, a part of the reserved oil is fed to the spiral groove 22*d* through the intake port 56 and the oil passages 58 and 54, to thereby ensure a formation of the oil seal at the top of the spiral guide wall 22*b* of the immovable scroll member 22.

Finally, it will be understood by those skilled in the art that the foregoing description is of preferred embodiments of the present invention, and that various changes and modifications thereof can be made without departing from the spirit and scope thereof.

We claim:

1. In a scroll type compressor comprising:

a housing; and immovable and movable scroll members housed in said housing and having spiral guide walls engaged with each other so that spaces for taking in a fluid including a lubricating oil mist to be compressed are formed therebetween, said movable scroll member being revolved around a center axis of the immovable scroll member in such a manner that, as said spaces are displaced toward a center of the immovable scroll member, a volume thereof is reduced to thereby cause a compression of the fluid in said spaces, said immovable scroll member having a passage through which each of said spaces is communicated with a discharge chamber upon reaching the center of the immovable scroll member, whereby the compressed fluid is successively discharged through said passage into said discharge chamber, the improvement comprising an oil-separating plate member provided in said discharge chamber oriented and located to assume a substantially horizontal position below said passage when said compressor is mounted for operation with said center axis oriented substantially horizontally, a reed valve element disposed at said passage for ensuring unidirectional fluid flow through said passage, and a retainer element for retaining said reed valve element, said reed valve element being operable between opened and closed conditions, and said retainer element being constructed to extend toward said plate member for directing said compressed fluid discharged from said passage past said reed valve in the reed valve opened condition to impinge upon an upper surface of said oil-separating plate member for separating lubricating oil from said fluid, and accumulating said separated oil in said discharge chamber up to the level of said upper surface of said oil-separating plate member.

2. A scroll type compressor as set forth in claim 1, wherein said housing includes a rear housing portion capable of being disassembled therefrom, said discharge chamber is defined by said immovable scroll member and said rear housing portion, and said oil-separating plate element includes a first portion supported by and projecting from said immovable scroll member and a second portion supported by and projecting from said rear housing portion.

3. A scroll type compressor as set forth in claim 1, wherein the spiral guide wall of said immovable scroll member has a groove formed along the guide wall at the top thereof, and said oil-separating plate member and spiral guide wall have an oil passage for feeding a part of said accumulated separated oil to said groove, to thereby ensure formation of an oil seal at said top of said spiral guide wall of said immovable scroll member.

* * * * *